US007572155B2

(12) United States Patent
Elliott, III et al.

(10) Patent No.: US 7,572,155 B2
(45) Date of Patent: Aug. 11, 2009

(54) ELECTRICAL CONNECTOR WITH PLUG TETHER ASSEMBLY AND RELATED METHODS

(75) Inventors: Kenneth C. Elliott, III, Ormond Beach, FL (US); James L. Zahnen, Ormond Beach, FL (US); Matthew D. Cawood, De Leon Springs, FL (US)

(73) Assignee: Thomas & Betts International, Inc., Wilmington, DE (US)

( * ) Notice: Subject to any disclaimer, the term of this patent is extended or adjusted under 35 U.S.C. 154(b) by 182 days.

(21) Appl. No.: 11/757,647

(22) Filed: Jun. 4, 2007

(65) Prior Publication Data

US 2007/0281556 A1 Dec. 6, 2007

Related U.S. Application Data

(60) Provisional application No. 60/803,932, filed on Jun. 5, 2006, provisional application No. 60/890,368, filed on Feb. 16, 2007.

(51) Int. Cl.
*H01R 9/22* (2006.01)

(52) U.S. Cl. ..... 439/709

(58) Field of Classification Search ..... 439/798, 439/590, 910, 709, 797, 796, 521, 135, 275, 439/488, 937, 596, 587, 136, 447, 445, 405, 439/475, 519, 276, 936, 212, 465, 701
See application file for complete search history.

(56) References Cited

U.S. PATENT DOCUMENTS 5,533,912 A 7/1996 Fillinger et al. ..... 439/521
5,863,221 A * 1/1999 Castaldo ..... 439/589
6,263,567 B1 7/2001 McGrane ..... 29/884
6,345,438 B1 2/2002 Zahnen et al. ..... 29/876
6,347,966 B1 2/2002 Hielscher ..... 439/798
6,688,921 B2 2/2004 Borgstrom et al. ..... 439/798
6,854,996 B2 * 2/2005 Yaworski et al. ..... 439/276
6,997,759 B1 2/2006 Zahnen et al. ..... 439/798
7,144,279 B2 12/2006 Zahnen et al. ..... 439/709
7,160,146 B2 1/2007 Cawood et al. ..... 439/521
2006/0286862 A1 * 12/2006 Lubinsky et al. ..... 439/521

* cited by examiner

*Primary Examiner*—Edwin A. Leon
(74) *Attorney, Agent, or Firm*—Allen, Dyer, Doppelt, Milbrath & Gilchrist, P.A.

(57) ABSTRACT

An electrical connector for a plurality of electrical cables may include an electrically conductive body having a plurality of spaced apart cable-receiving passageways for receiving electrical cable ends therein. The electrically conductive body may also have at least one respective fastener-receiving passageway intersecting each cable-receiving passageway, an insulating cover on the electrically conductive body, and respective cable and fastener inlets aligned with each cable-receiving and fastener-receiving passageway. A plurality of plug tether assemblies may each include a base engaged with an upper end portion of a respective cable inlet, and may have a first and second tether extending outwardly from the base. A cable inlet plug may be coupled to the first tether and be removably positioned in a respective cable inlet. A fastener inlet plug may be coupled to the second tether and removably positioned in a respective fastener inlet.

33 Claims, 9 Drawing Sheets

ELECTRICAL CONNECTOR WITH PLUG TETHER ASSEMBLY AND RELATED METHODS

RELATED APPLICATION

The present application is based upon prior filed copending provisional application Ser. No. 60/803,932 filed Jun. 5, 2006 and provisional application Ser. No. 60/890,368 filed Feb. 16, 2007, the entire subject matter of which are incorporated herein by reference in their entireties.

FIELD OF THE INVENTION

The present invention relates to the field of electrical components, and, more particularly, to an electrical connector for connecting together a plurality of cable ends, and associated methods.

BACKGROUND OF THE INVENTION

Underground and submersible junction bus connectors are widely used in electrical power distribution systems. One type of such connector is offered under the designation SWEETHEART® by Homac Mfg. Company of Ormond Beach, Fla., the assignee of the present invention. The SWEETHEART® connector is a cast or welded aluminum connector including a bus, or bar, portion and a series of tubular posts extending outwardly from the bus portion. The posts have an open upper end to receive one or more electrical conductors. A threaded bore is provided in the sidewall of the post, and which receives a fastener to secure the electrical conductor within the upper end of the post. An insulating coating is provided on the lower portion of the posts and bus of the connector. In addition, EPDM insulating sleeves may be used to provide waterproof seals for the posts. U.S. Pat. Nos. 6,347,966; 6,345,438 and 6,263,567 disclose various embodiments of such bus and post connectors.

Homac also manufacturers a RAB series of "Flood Seal"® Rubberized Aluminum Bar connectors suitable for direct burial, handhole or pedestal applications. The RAB connector includes a generally rectangular aluminum body having a plurality of spaced apart cable-receiving passageways therein. As the name states, the RAB connector includes a rubber insulating cover over the connector body. The insulating cover includes integrally molded inlets for both the cable-receiving openings and fastener-receiving openings. An insulating boot, such as a cable size adaptor or Rocket may be provided for the cable-receiving inlet, and a sealing cap may be received over the screw in the fastener-receiving inlet.

U.S. Pat. No. 6,688,921 to Borgstrom et al. discloses a connector similar to the Homac RAB series connector. In place of EPDM, the patent uses a thermoplastic elastomer (TPE) that combines the properties of thermoplastic with the performance characteristics of a thermoset rubber. The use of TPE enables the molding to further form sealing plugs attached to the cover with respective tethers. A cable size adaptor is frangibly connected to each sealing plug via an integrally molded web.

Michaud Electrical Equipment of France offered an insulation displacing connector (IDC) including a generally rectangular connector body, and transverse cable-receiving and fastener-receiving passageways. More particularly, the connector body included a backwall having a pattern of sharp ridges thereon to pierce the insulation on the cable end as the end of the fastener engages and presses against the cable end from the opposite side. To be sure the cable end is fully pressed onto the sharp ridges, a plastic viewing window is provided opposite the inlet of the cable-receiving passageway. Accordingly, an installer can view the cable end to be sure the insulation has been pierced. The window is adjacent the rubber cover. Unfortunately, the Michaud IDC device is likely to leak at the window since the seal is only a mechanical seal. In addition, insulation displacement technology may not be suitable for larger cable sizes with thicker insulation coverings.

A significant advance in the area of connectors is disclosed in U.S. Pat. No. 7,144,279, assigned to Homac Mfg. Company, the assignee of the present invention. The connector includes an electrically conductive body, a thermoplastic elastomer (TPE) insulating cover, and windows aligned with cable end viewing openings in the conductive body. The electrically conductive body has spaced apart cable-receiving passageways for receiving respective electrical cable ends therein, and with each cable-receiving passageway having a cable inlet opening and a cable end viewing opening opposite the cable inlet opening. The electrically conductive body also has a respective fastener-receiving passageway intersecting each of the cable-receiving passageways. The windows provide a cover and permit visual confirmation of proper placement of the electrical cable end within a corresponding one of the cable-receiving passageways. The electrical connector also includes a respective removable fastener inlet closure cap for each tubular fastener inlet, and a respective flexible tether having a proximal end removably connected adjacent a corresponding tubular fastener inlet and a distal end integrally molded with a corresponding removable fastener inlet closure cap. A respective insulating boot may be received in each of the tubular cable inlets. Each insulating boot may include a tubular sidewall having a progressively increasing diameter to an open outer end thereof, a removable boot closure cap for removable positioning in the open outer end of the tubular sidewall, and an integrally molded tether connecting the removable boot closure cap to the tubular sidewall.

U.S. Pat. No. 7,160,146 to Cawood et al., and assigned to the assignee of the present application, discloses an insulating boot associated with the conductor receiving passageway of an electrical connector. The insulating boot may include an insulating tube, and at least one rupturable seal closing the insulating tube and rupturing upon initial insertion of the cable end therethrough. The rupturable seal may also be compliant to accommodate different sized cable ends and form a seal with adjacent portions of the cable end. A pair of seals may be provided with an optional sealant material therebetween.

While there has been some limited use of tethers for various connector plugs for the fastener inlets, there may still be components, such as adaptors, that can become separated from the connector in the field. If such components become lost the sealing integrity of the connector may suffer.

SUMMARY OF THE INVENTION

In view of the foregoing background, it is therefore an object of the present invention to provide an electrical connector that may be readily manufactured, and which is more likely to keep its components together.

This and other objects, features, and advantages in accordance with the present invention are provided by an electrical connector for a plurality of electrical cables comprising an electrically conductive body having a plurality of spaced apart cable-receiving passageways for receiving electrical cable ends therein, and including plug tether assemblies. The electrically conductive body may also have at least one respective fastener-receiving passageway intersecting each of the cable-receiving passageways. An insulating cover may be included on the electrically conductive body and may have a respective cable inlet aligned with each of the cable-receiving passageways, and a respective fastener inlet aligned with each of the fastener-receiving passageways.

More particularly, each plug tether assembly may comprise a base for engaging an upper end portion of a respective cable inlet, a first tether extending outwardly from the base, a cable inlet plug coupled to the first tether and for being removably positioned in a respective cable inlet, a second tether extending outwardly from the base, and a fastener inlet plug coupled to the second tether and for being removably positioned in a respective fastener inlet. The base, first and second tethers, the cable inlet plug, and the fastener inlet plug may be integrally molded as a monolithic unit. Accordingly, the plug tether assembly facilitates manufacturing and keeps the plugs with the connector even when not used or temporarily removed for access.

The first and second tethers may each comprise a flexible strap. The base may include a base ring, for example. The first and second tethers may extend outwardly from opposite sides of the base ring.

In addition, the base may be received within a respective cable inlet. The electrical connector may further comprise a cable end seal within the respective cable inlet and retained therein by the base.

Each plug tether assembly of the electrical connector may further comprise at least one first snap-fitting feature carried by the base. A respective cable inlet may also comprise at least one second snap-fitting feature cooperating with the at least one first snap-fitting feature. The at least one first snap-fitting feature may include at least one loop, and the at least one second swap-fitting feature may include at least one tab.

The fastener plug inlet may include at least one hollow closure cap and a gripping member that extends outwardly from the cap. Also, each plug tether assembly may comprise at least one of rubber and a thermoplastic elastomer (TPE), for example.

Another aspect of the invention relates to a method for making an electrical connector for a plurality of electrical cables. The method may include forming an electrically conductive body having a plurality of spaced apart cable-receiving passageways for receiving electrical cable ends therein, and having at least one respective fastener-receiving passageway intersecting each of the cable-receiving passageways. An insulating cover may be positioned on the electrically conductive body and may have a respective cable inlet aligned with each of the cable-receiving passageways, and a respective fastener inlet aligned with each of the fastener-receiving passageways.

The method may further include forming a plurality of plug tether assemblies, each comprising a base for engaging an upper end portion of a respective cable inlet, a first tether extending outwardly from the base, a cable inlet plug coupled to the first tether and for being removably positioned in a respective cable inlet, a second tether extending outwardly from the base, and a fastener inlet plug coupled to the second tether and for being removably positioned in a respective fastener inlet. Another method aspect relates to forming a plug tether assembly.

DETAILED DESCRIPTION OF THE PREFERRED EMBODIMENTS

Figure 1:
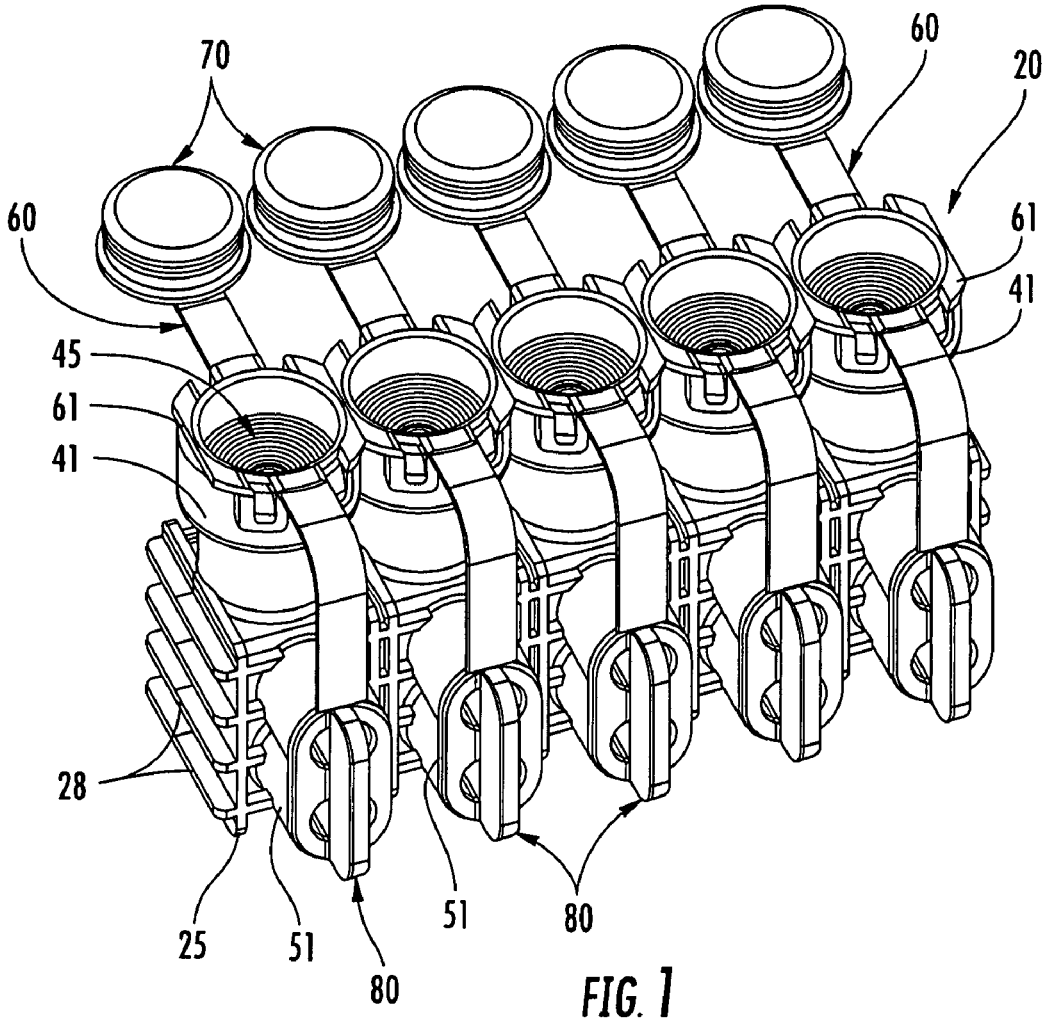
FIG. 1 is a front perspective view of an embodiment of an electrical connector in accordance with the present invention.
Figure 2:
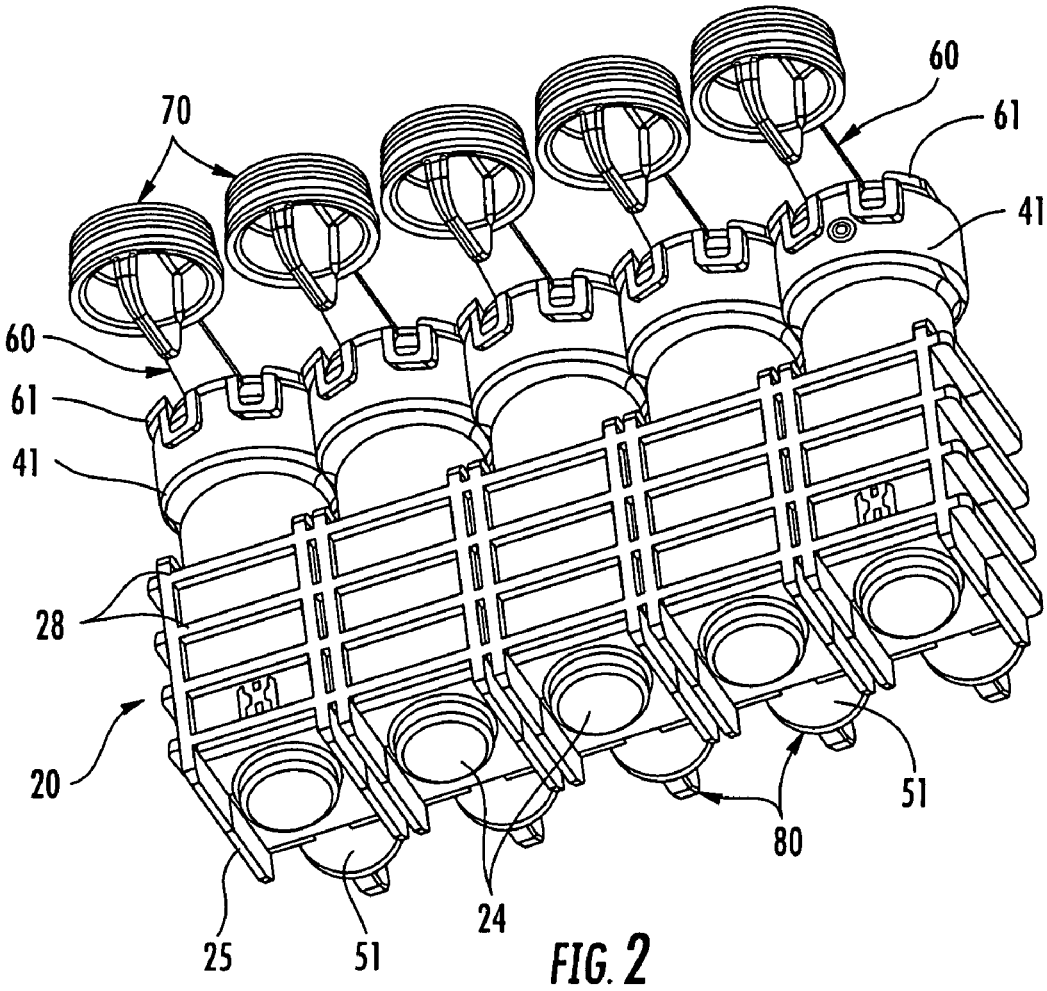
FIG. 2 is a rear perspective view of the electrical connector shown in FIG. 1.

The present invention will now be described more fully hereinafter with reference to the accompanying drawings in which preferred embodiments of the invention are shown. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and prime and double prime notation are used to indicate similar elements in alternative embodiments.

Referring now initially to FIGS. 1-6, an electrical connector 20 in accordance with the present invention is described. The electrical connector 20 is for a plurality of electrical cables and illustratively comprises an electrically conductive body 21 (FIG. 6), an insulating cover 25, and a plurality of windows 24 (FIG. 2) aligned with cable end viewing openings 23 (FIG. 6) in the conductive body. The electrically conductive body 21 illustratively has a generally rectangular shape, and may be formed of aluminum, or other conductive material, for example.

Figure 6:
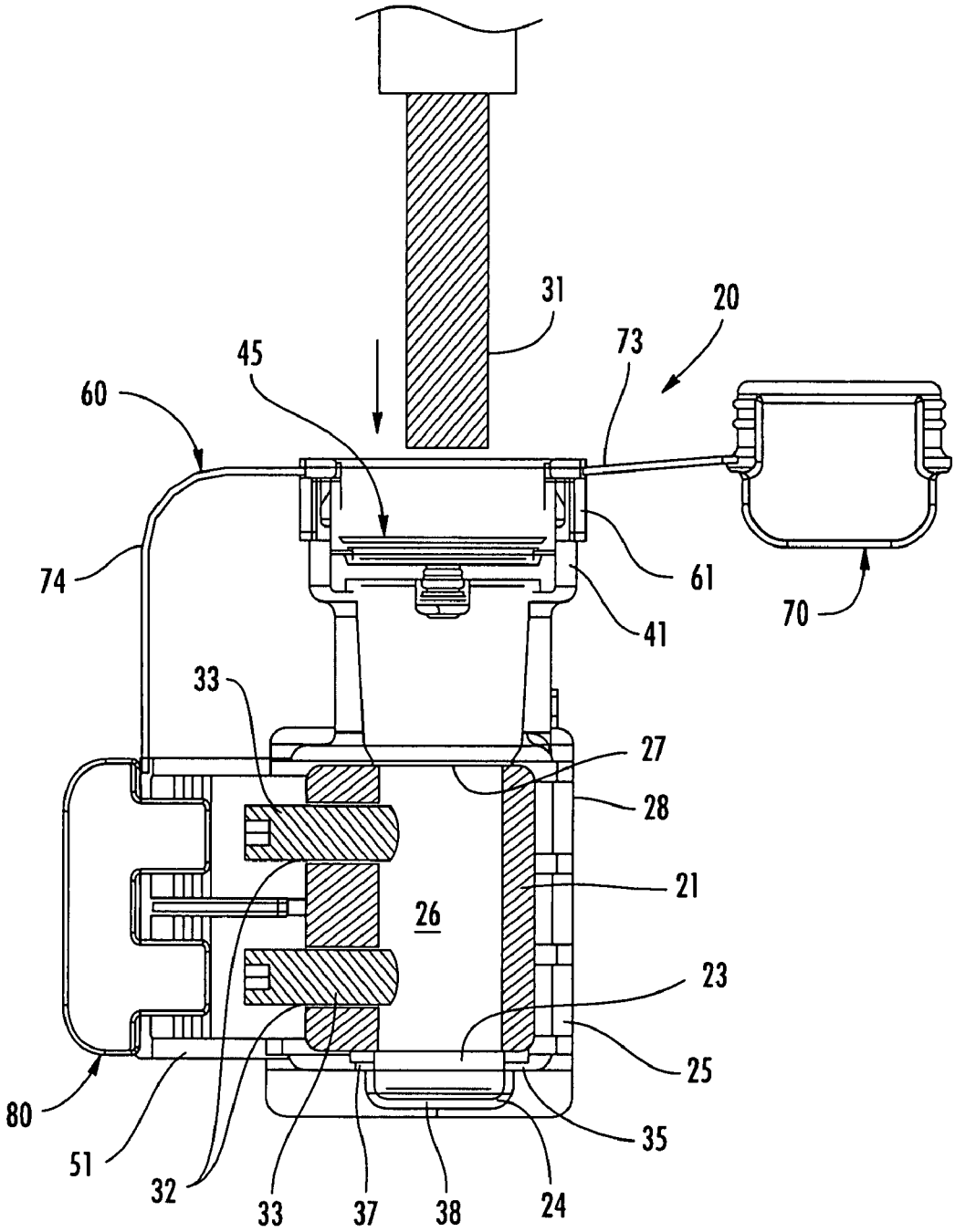
FIG. 6 is a cross-sectional view of the electrical connector shown in FIG. 1.
Figure 7:
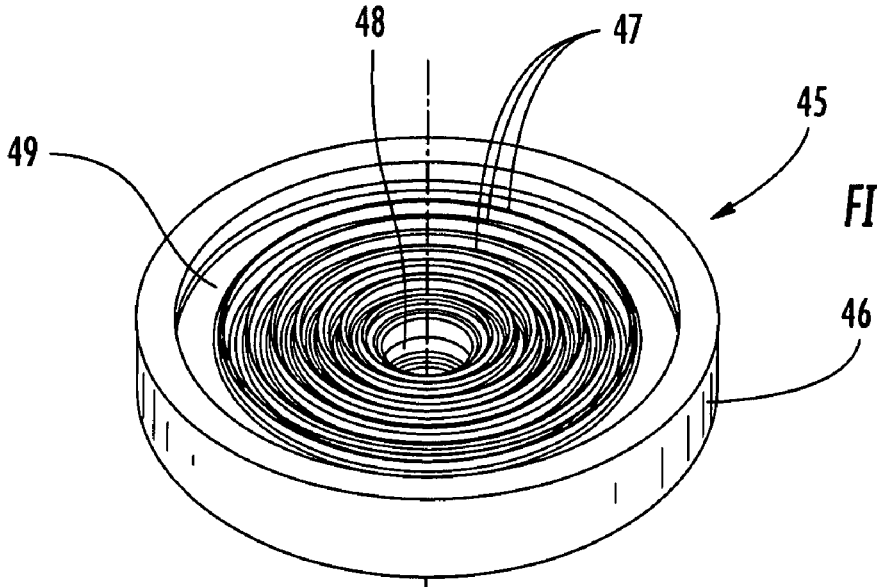
FIG. 7 is a top perspective view of the cable end seal of the electrical connector shown in FIG. 1.
Figure 8:
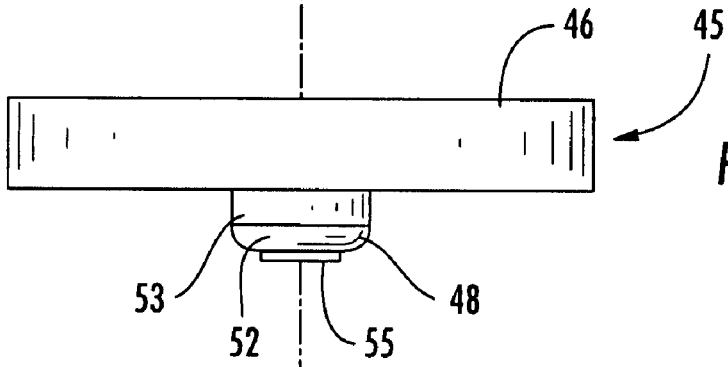
FIG. 8 is a side elevational view of the cable end seal shown in FIG. 7.
Figure 9:
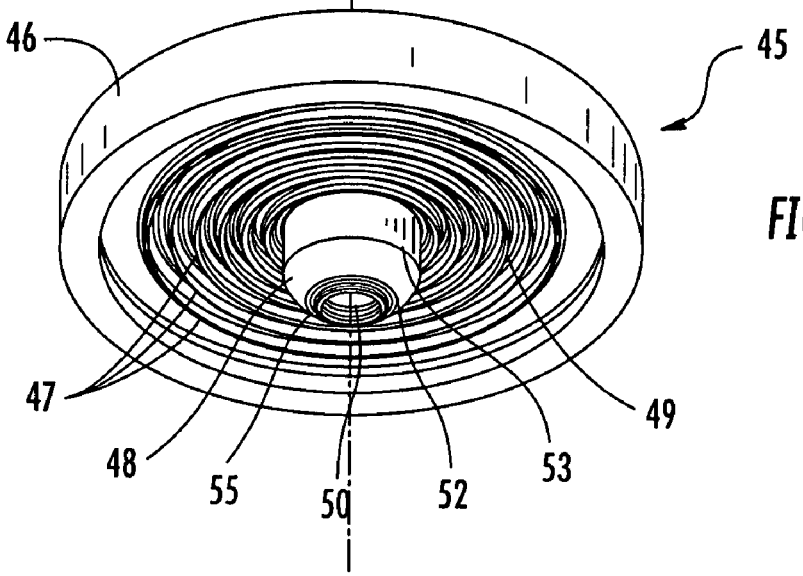
FIG. 9 is a bottom perspective view of the cable end seal shown in FIG. 7.
Figure 10:
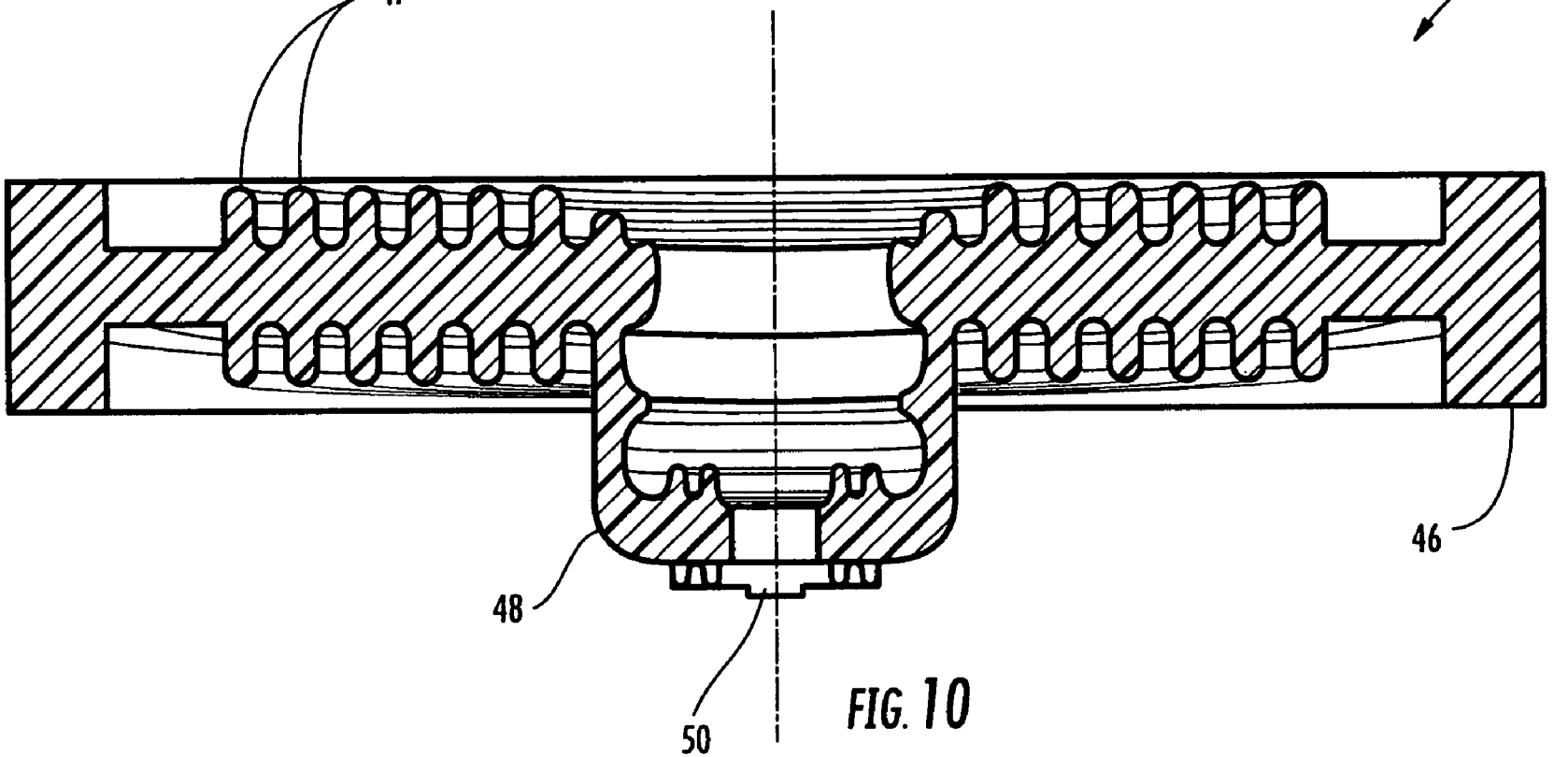
FIG. 10 is an enlarged cross-sectional view of the cable end seal shown in FIG. 7.

The electrically conductive body 21 also has a plurality of spaced apart cable-receiving passageways 26 each for receiving a respective insulation-free electrical cable end 31 therein (FIG. 6). In the illustrated embodiment of the electrical connector 20, five such passageways 26 are provided, however in other embodiments, more or less than five may be provided as will be appreciated by those skilled in the art. Of course, not all of the cable-receiving passageways need be used.

Each cable-receiving passageway 26 has a cable inlet opening 27 and the cable end viewing opening 23 opposite the cable inlet opening (FIG. 6). The electrically conductive body 21 also illustratively has a pair of respective fastener-receiving passageways 32 intersecting each cable-receiving passageway 26 (FIG. 6). A respective fastener 33 is also provided in each of the fastener-receiving passageways 32 (FIG. 6). Each of the fasteners 33 may be a hex head fastener with a rounded contacting end, for example. In addition, in other embodiments, only one fastener may be used for each cable end 31 as will be appreciated by those skilled in the art.

Each electrically insulating transparent viewing window 24 may be positioned adjacent a respective cable end viewing opening 23. The windows 24 thereby provide a cover and permit visual confirmation of proper placement of the insulation-free electrical cable end 31 within a corresponding one of the cable-receiving passageways 26. By transparent is meant that proper positioning of the cable end 31 is visible therethrough. Accordingly, although the window 24 can be fully transparent, transparent is also meant to include partially transparent or translucent where proper seating of the cable end is still viewable.

The insulating cover 25 on the electrically conductive body 21 also has respective window openings 35 therein aligned with the transparent viewing windows 24 (FIG. 6). The insulating cover 25 may preferably comprise TPE in some embodiments thereby forming an integrally molded bond with adjacent portions of the transparent viewing windows 24 as will be appreciated by those skilled in the art. In other embodiments, the cover 25 may comprise other plastic or rubber insulating materials. Each of the transparent viewing windows 24 may comprise a mounting flange 37 and a lens 38 extending outwardly therefrom. This configuration of the transparent viewing window 24 and through-holes, as contrasted with blind holes, permits the cable end 31 to extend further past the fasteners 33 to thereby result in a more secure connection as will be appreciated by those skilled in the art.

The mounting flange 37 may be overlapped by adjacent portions of the insulating cover 25. The mounting flange 37 and the lens 38 may be integrally formed as a monolithic unit, for example, such as by molding. Each transparent viewing window 24 may comprise polypropylene to form a strong bond with the TPE of the insulating cover 25. Other similar compatible materials may also be used that are moldable and that form a strong bond to the material of the insulating cover 25. The window 24 may serve to close or seal the cable-receiving passageway 26 during molding of the insulating cover 25. Of course, as will be appreciated by those skilled in the art, the windows 24 may not be needed in other embodiments.

The insulating cover 25 also illustratively includes an integrally molded respective cable inlet 41 aligned with each of the cable inlet openings 27. Each cable inlet 41 is tubular in shape in the illustrated embodiment, although other shapes are possible as well. The electrical connector 20 may further include a respective cable end seal 45 received in each of the cable inlets 41 as will be described in greater detail below. The insulating cover 25 also illustratively comprises an integrally molded respective dual-port fastener inlet 51 aligned with each of the fastener-receiving passageways 32 (FIG. 6). The fastener inlet 51 is also illustratively tubular, but could have other shapes in other embodiments. In other embodiments a single-port fastener inlet could be provided for use with either a single fastener, or with multiple fasteners. The cover 25 also illustratively includes external ribs 28 that provide additional mechanical protection, facilitate gripping by an installer, provide flow channels during molding, and/or may provide enhanced heat dissipation for the connector 20.

Figure 3:
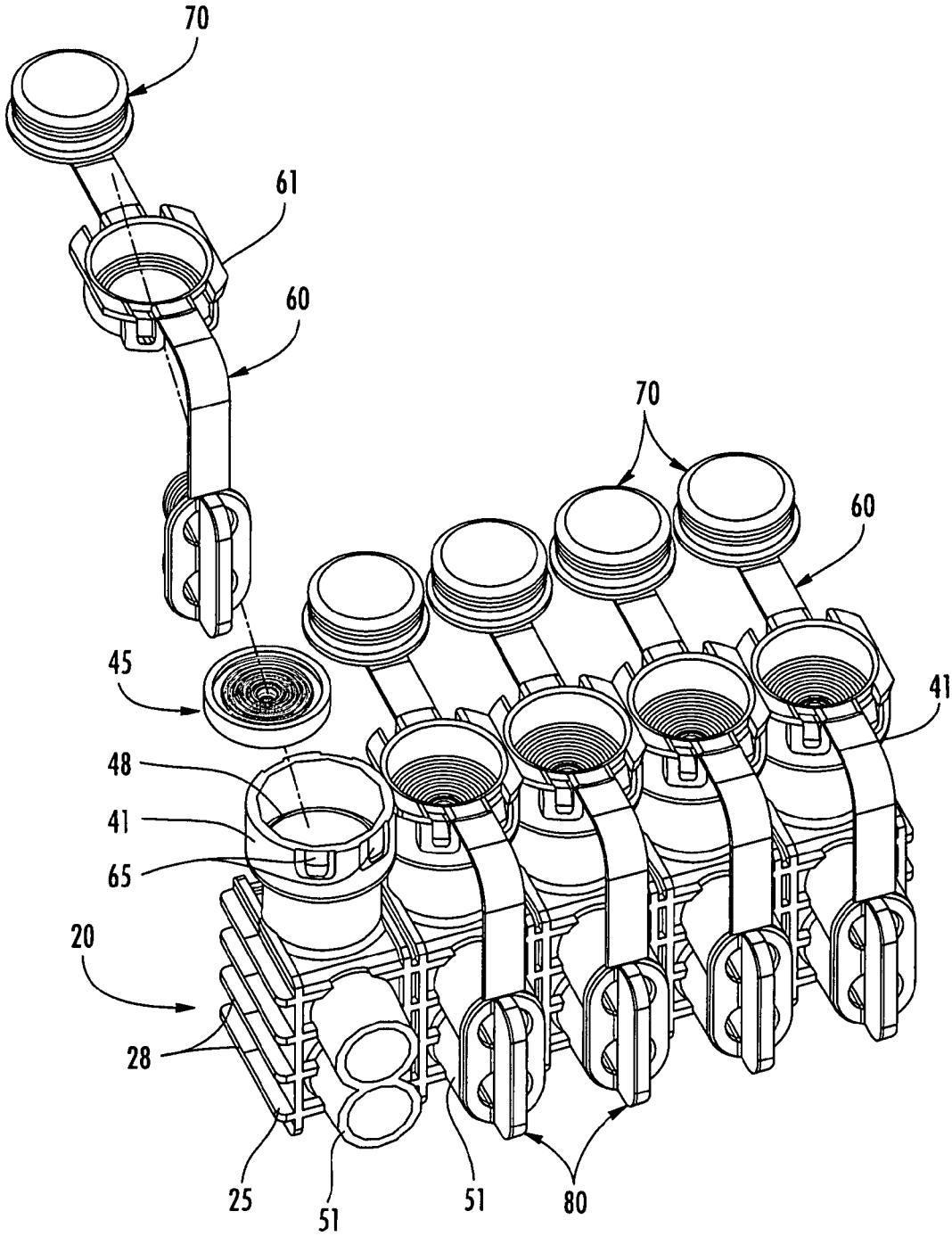
FIG. 3 is a front perspective partially exploded view of the electrical connector shown in FIG. 1.
Figure 4:
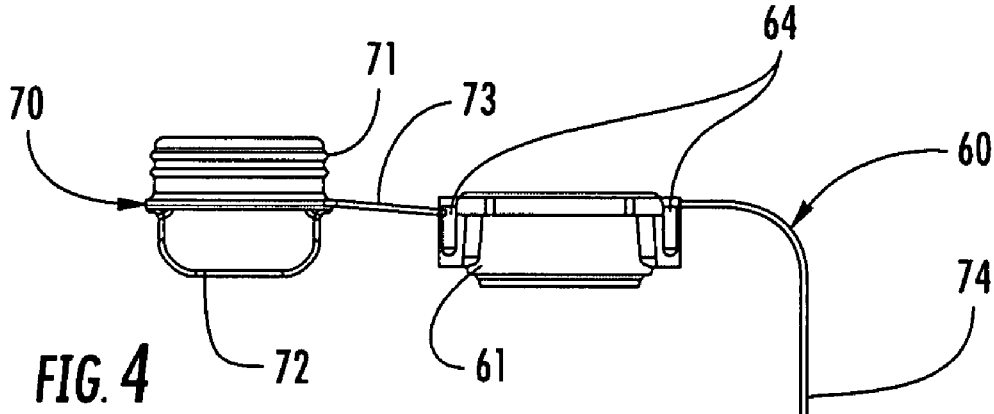
FIG. 4 is a side elevational view of the tether assembly of the electrical connector shown in FIG. 1.
Figure 5:
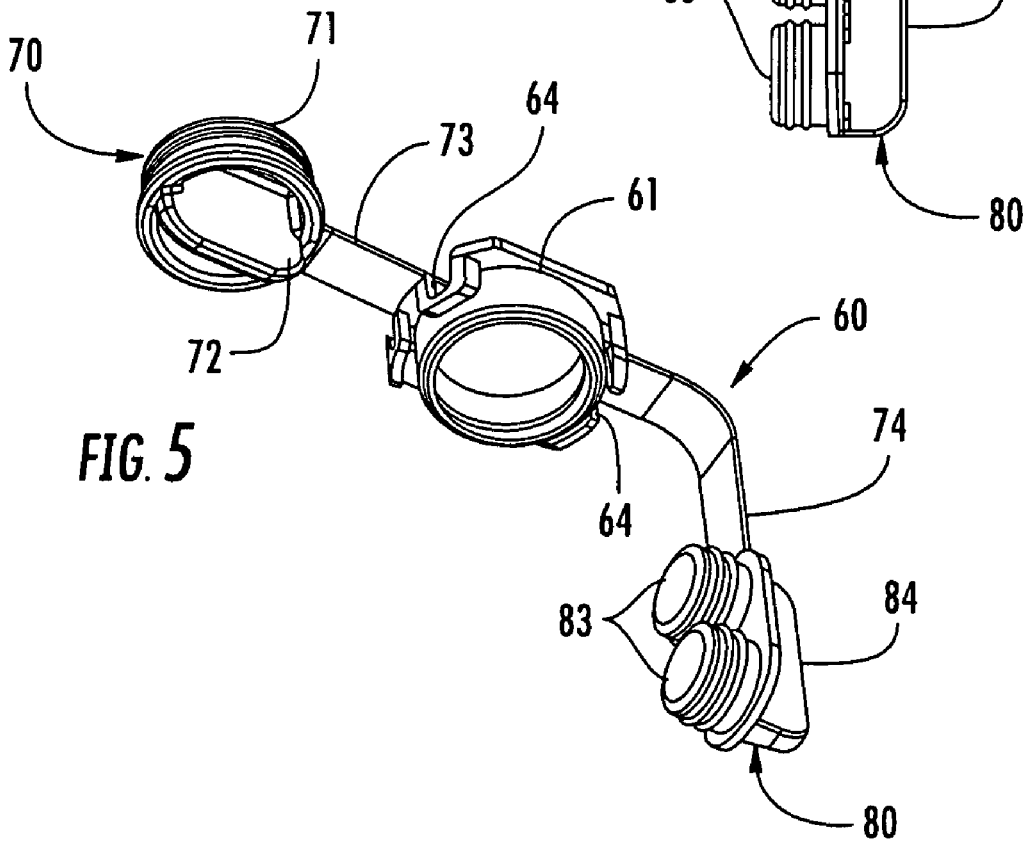
FIG. 5 is a bottom perspective view of the tether assembly shown in FIG. 4.

The electrical connector 20 also includes a plurality of plug tether assemblies 60r the components of which are perhaps best understood with specific reference to FIGS. 4 and 5. The plug tether assembly 60 illustratively includes a base ring 61 received in a snap-fitting engagement on the upper end portion of the cable-receiving inlet 41 (FIG. 3). The base ring 61 carries external locking loops 64 that cooperate with corresponding tabs 65 (FIG. 3) on the cable-receiving inlet 41 to provide the snap-fitting engagement as will be appreciated by those skilled in the art. In other words, the external locking loops 64 may be considered as providing first snap-fitting features, and the tabs 65 may be considered as providing second snap-fitting features. Of course in other embodiments, the base may have a different shape other than a ring-shape, and different mechanical and/or adhesive approaches may be used to secure the plug tether assembly 60 insulating cover 25 as will also be appreciated by those skilled in the art.

As perhaps best seen in the exploded view portion of FIG. 3, the base ring 61 is illustratively received within the upper end of the cable inlet 41 and serves to capture the cable end seal 45 in position against the internal shoulder 48 of the cable inlet 41. This arrangement also facilitates manufacturing and assembly of the connector 20 as will be appreciated by those skilled in the art.

The plug tether assembly 60 illustratively includes a cable inlet plug 70 joined to the base ring 61 via a first flexible tether strap 73. The cable inlet plug 70 illustratively includes a hollow closure cap 71 to be removably received in the cable inlet opening 27, and a gripping member 72 extending from within the closure cap to outside of the cap. The gripping member 72 may be grasped by the installer, either manually or using a suitable tool.

The plug tether assembly 60 also includes a fastener inlet plug 80 joined to the base ring 61 via a second flexible tether strap 74. The first flexible tether strap 73 and the second flexible tether strap 74 extend outwardly from opposite sides of the base ring 61. The inlet plug 80 illustratively includes two closure caps 83 and an associated gripping member 84. Of course in other embodiments, only a single closure cap 83 may be used. The fastener inlet plug 80 provides selective access to permit tightening of the fasteners 33 and thereafter provides an environmental seal.

As will be readily appreciated by those skilled in the art, the plug tether assembly 60 may be integrally molded as a unitary body from a suitable material, such as a TPE material or rubber material, for example. The plug tether assemblies 60 may also be made out of two or more grades of TPE, a single grade of TPE, or a TPE and polypropylene, for example. Of course, other suitable materials may also be used. Accordingly, while the plug tether assemblies 60 facilitate manufacturing, they also keep the plugs 70, 80 and other portions of the connector 20 together so they remain together even when the plugs are not being used or are temporarily removed for access.

Referring now additionally to FIGS. 7-11, features of the cable end seal 45 are further described. The seal 45 includes an annular tear stop member 49 and an outer ring-shaped body 46 surrounding the outer portion of the annular tear stop member. The annular tear stop member 49 illustratively includes a series of concentric annular ribs 47. The material of the seal 45 is desirably elastic to accommodate different sized wires and/or cables as will be appreciated by those skilled in the art. Depending on the size of the wire or cable end, the tear stop member 49 may be torn out to a concentric ring or rib 47 which then forms a tight seal to the adjacent cable end portions as will be appreciated by those skilled in the art.

Figure 11:
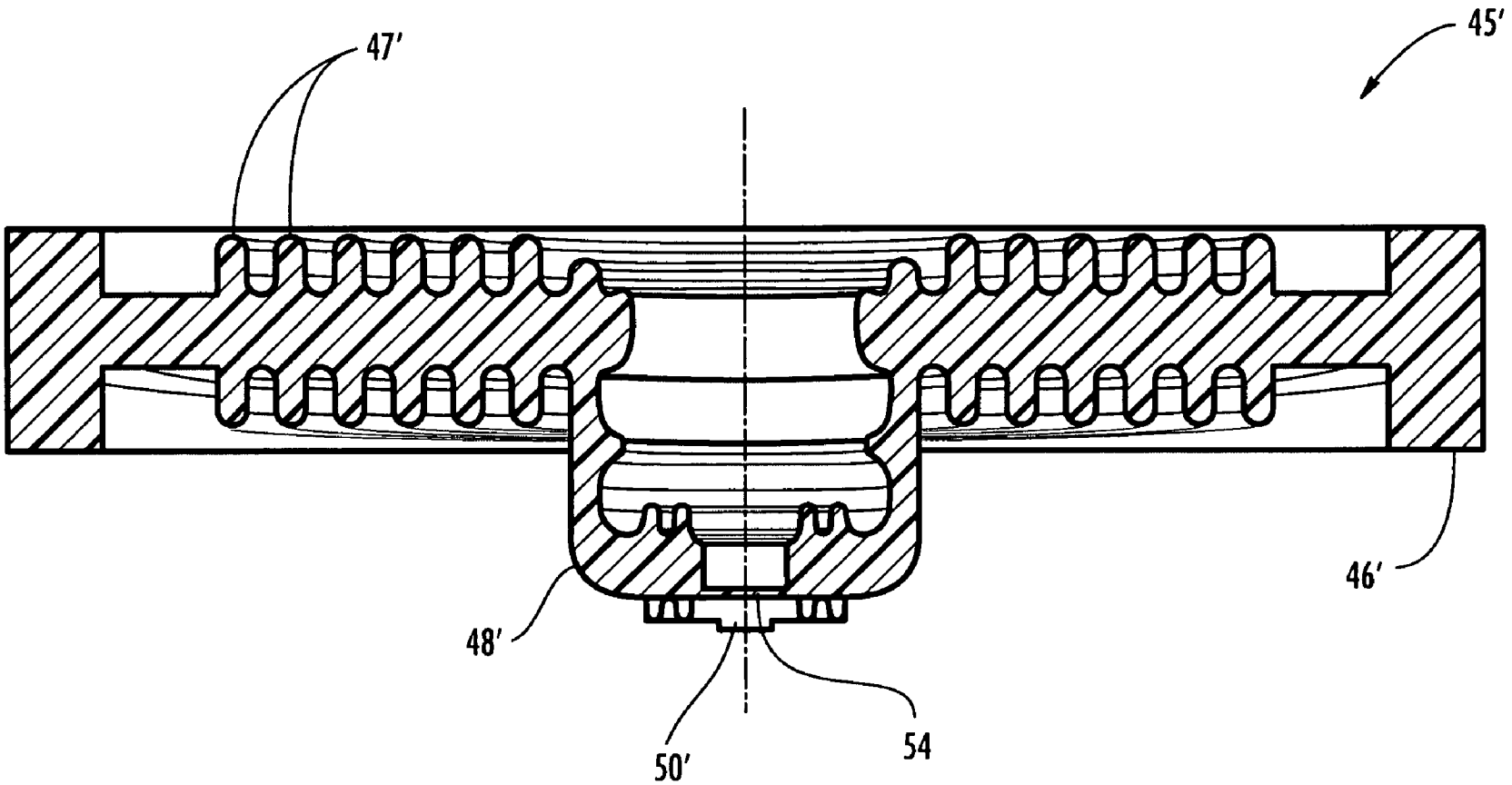
FIG. 11 is a cross-sectional view of another embodiment of the cable end as shown in FIG. 10.

A nipple 48 is illustratively coupled to the inner portion of annular tear stop member. The nipple 48 depends from the annular tear stop 49 into a respective cable inlet 41 as illustrated in FIG. 6, for example. The nipple 48 includes a central opening 50 therethrough in the illustrated embodiments of FIGS. 7-10. In the alternative embodiment of the seal 45' shown in FIG. 11, this opening 50' may be initially closed by a rupturable membrane 54 as will be appreciated by those skilled in the art. Those other elements shown in FIG. 11 are indicated with prime notation and are similar to those described above.

The nipple 48 also includes a tubular body portion 53 and end portion 52 coupled to the nipple. Illustratively, the nipple 48 includes a concentric rib 55 carried by the end portion 52. More than one concentric rib may be carried by the end portion 52.

The nipple 48 desirably guides and directs a relatively small gauge wire or cable therethrough and forms an environmental seal thereagainst. For larger cable ends, the nipple 48 may be torn away, or torn partly out of the way, and the cable end will seal against the respective adjacent annular rib 47. In other words, the properly sized rib 47 will serve as a tear stop and seal against the cable end as will be appreciated by those skilled in the art. This feature permits the concentric ring section to facilitate a range of wire or cable sizes without undue stress. In addition, the seal 45 and the tear stop member 49 may be integrally molded as one piece from a material, such as a silicone material, for example, that provides the desired degree of elasticity or resilience.

Figure 12:
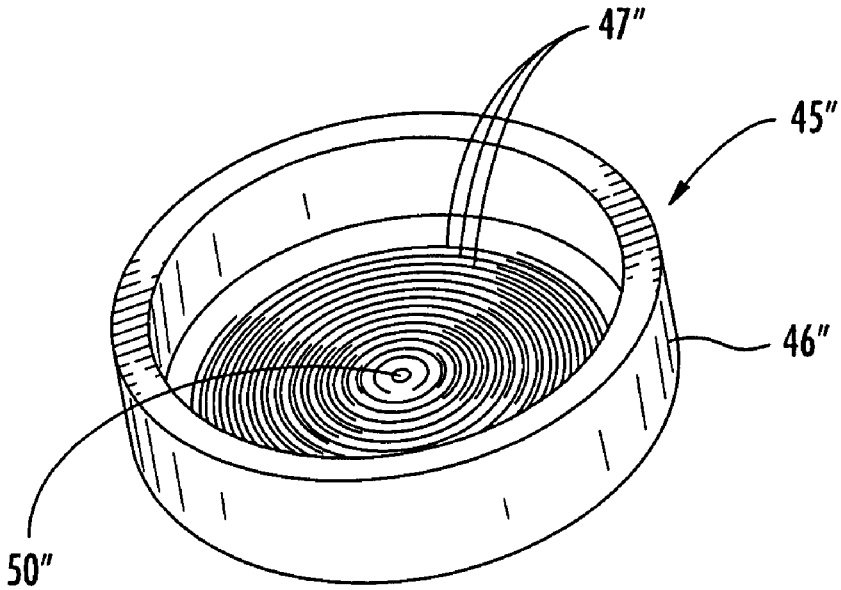
FIG. 12 is a perspective view of yet another embodiment of a cable end seal according to the present invention.
Figure 13:
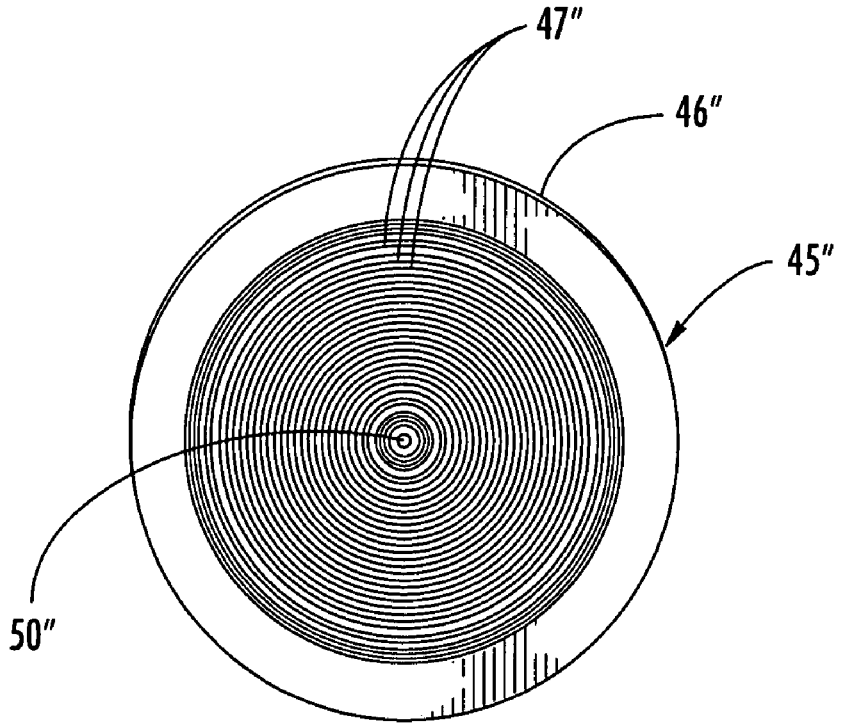
FIG. 13 is a top plan view of the cable end seal shown in FIG. 12.

Referring now additionally to FIGS. 12 and 13 yet another embodiment of a cable end seal 45" is now described. In this embodiment there is no nipple, but rather the concentric ribs or rings 47" of the tear stop 49" extend into the central area. The tear stop 49" is carried by the outer ring-shaped body 46". In the illustrated embodiment, the seal 45" has a central opening 50", but in other embodiments the opening may be initially closed by a rupturable membrane as will be appreciated by those skilled in the art.

A method aspect of the invention is directed to a method for making the electrical connector 20 including forming and attaching a plug tether assembly 60 to each cable inlet 41 as described above. Another method is directed to making the cable seal 45 described above and/or positioning it within the cable inlet 41 as also described above. Of course, other methods are also contemplated by the present invention based upon the connector described herein.

Other features and advantages in accordance with the invention may be understood with reference to copending application entitled: ELECTRICAL CONNECTOR INCLUDING CABLE END SEAL AND ASSOCIATED METHODS, Attorney Docket No. 64570, the entire contents of which is incorporated herein by reference, as well as in the above-mentioned U.S. Pat. Nos. 7,144,279 and 7,160,146, the entire contents of which are incorporated herein by reference. Indeed, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that other modifications and embodiments are intended to be included within the scope of the invention.

That which is claimed is:

1. An electrical connector for a plurality of electrical cables comprising:

an electrically conductive body having a plurality of spaced apart cable-receiving passageways for receiving electrical cable ends therein, and having at least one respective fastener-receiving passageway intersecting each of the cable-receiving passageways;

an insulating cover on said electrically conductive body and having a respective cable inlet aligned with each of the cable-receiving passageways and a respective fastener inlet aligned with each of the fastener-receiving passageways; and a plurality of plug tether assemblies, each comprising a base for engaging an upper end portion of a respective cable inlet, a first tether extending outwardly from said base, a cable inlet plug coupled to said first tether and for being removably positioned in a respective cable inlet, a second tether extending outwardly from said base, and a fastener inlet plug coupled to said second tether and for being removably positioned in a respective fastener inlet.

2. The electrical connector according to claim 1 wherein said base, said first and second tethers, said cable inlet plug, and said fastener inlet plug are integrally molded as a monolithic unit.

3. The electrical connector according to claim 1 wherein said first and second tethers each comprises a flexible strap.

4. The electrical connector according to claim 1 wherein said base comprises a base ring; and wherein said first and second tethers extend outwardly from opposite sides of said base ring.

5. The electrical connector according to claim 1 wherein said base is received within a respective cable inlet.

6. The electrical connector according to claim 5 further comprising a cable end seal within the respective cable inlet and retained therein by said base.

7. The electrical connector according to claim 1 wherein each plug tether assembly further comprises at least one first snap-fitting feature carried by said base; and wherein a respective cable inlet comprises at least one snap-fitting feature cooperating with said at least one first snap-fitting feature.

8. The electrical connector according to claim 7 wherein said at least one first snap-fitting feature comprises at least one loop; and wherein said at least one second snap-fitting feature comprises at least one tab.

9. The electrical connector according to claim 1 wherein said cable inlet plug comprises a hollow closure cap and a gripping member extending outwardly therefrom.

10. The electrical connector according to claim 1 wherein said fastener inlet plug comprises at least one hollow closure cap and a gripping member extending outwardly therefrom.

11. The electrical connector according to claim 1 wherein each plug tether assembly comprises at least one of rubber and a thermoplastic elastomer (TPE).

12. A plug tether assembly for an electrical connector of a type comprising an electrically conductive body having a plurality of cable-receiving passageways and at least one fastener-receiving passageway intersecting each cable receiving passageway, and an insulating cover thereon having a respective cable inlet aligned with each cable-receiving passageway, and a respective fastener inlet aligned with each fastener-receiving passageway, the plug tether assembly comprising:

a base for engaging an upper end portion of a respective cable inlet;

a first tether extending outwardly from said base;

a cable inlet plug coupled to said first tether and for being removably positioned in a respective cable inlet;

a second tether extending outwardly from said base; and a fastener inlet plug coupled to said second tether and for being removably positioned in a respective fastener inlet.

13. The plug tether assembly according to claim 12 wherein said base, said first and second tethers, said cable inlet plug, and said fastener inlet plug are integrally molded as a monolithic unit.

14. The plug tether assembly according to claim 12 wherein said first and second tethers each comprises a flexible strap.

15. The plug tether assembly according to claim 12 wherein said base comprises a base ring; and wherein said first and second tethers extend outwardly from opposite sides of said base ring.

16. The plug tether assembly according to claim 12 further comprising at least one first snap-fitting feature carried by said base.

17. The plug tether assembly according to claim 12 wherein said cable inlet plug comprises a hollow closure cap and a gripping member extending outwardly therefrom; and wherein said fastener inlet plug comprises at least one hollow closure cap and a gripping member extending outwardly therefrom.

18. A method for making an electrical connector for a plurality of electrical cables comprising:

forming an electrically conductive body to have a plurality of spaced apart cable-receiving passageways for receiving electrical cable ends therein, and at least one respective fastener-receiving passageway intersecting each of the cable-receiving passageways;

positioning an insulating cover on the electrically conductive body and having a respective cable inlet aligned with each of the cable-receiving passageways, and a respective fastener inlet aligned with each of the fastener-receiving passageways; and forming a plurality of plug tether assemblies, each comprising a base for engaging an upper end portion of a respective cable inlet, a first tether extending outwardly from the base, a cable inlet plug coupled to the first tether and for being removably positioned in a respective cable inlet, a second tether extending outwardly from the base, and a fastener inlet plug coupled to the second tether and for being removably positioned in a respective fastener inlet.

19. The method according to claim 18 wherein the base, first and second tethers, the cable inlet plug, and the fastener inlet plug are integrally molded as a monolithic unit.

20. The method according to claim 18 wherein the first and second tethers each comprises a flexible strap.

21. The method according to claim 18 wherein the base comprises a base ring; and wherein the first and second tethers extend outwardly from opposite sides of the base ring.

22. The method according to claim 18 wherein the base is received within a respective cable inlet.

23. The method according to claim 22 further comprising a cable end seal within the respective cable inlet and retained therein by the base.

24. The method according to claim 18 wherein each plug tether assembly further comprises at least one first snap-fitting feature carried by the base; and wherein a respective cable inlet comprises at least one second snap-fitting feature cooperating with the at least one first snap-fitting feature.

25. The method to claim 24 wherein the at least one first snap-fitting feature comprises at least one loop; and wherein the at least one second fitting feature comprises at least one tab.

26. The method according to claim 18 wherein the cable inlet plug comprises a hollow closure cap and a gripping member extending outwardly therefrom; and wherein the fastener inlet plug comprises at least one hollow closure cap and a gripping member extending outwardly therefrom.

27. The method according to claim 18 wherein each plug tether assembly comprises at least one of rubber and a thermoplastic elastomer (TPE).

28. A method for making a plug tether assembly for an electrical connector of a type comprising an electrically conductive body having a plurality of cable-receiving passageways and at least one fastener-receiving passageway intersecting each cable-receiving passageway, and an insulating cover thereon having a respective cable inlet aligned with each cable-receiving passageway and a respective fastener inlet aligned with each fastener-receiving passageway, the plug tether assembly comprising:

forming a base for engaging an upper end portion of a respective cable inlet;

forming a first tether extending outwardly from the base;

forming a cable inlet plug coupled to the first tether and for being removably positioned in a respective cable inlet;

forming a second tether extending outwardly from the base; and forming a fastener inlet plug coupled to the second tether and for being removably positioned in a respective fastener inlet.

29. The method according to claim 28 wherein the base, first and second tethers, the cable inlet plug, and the fastener inlet plug are integrally molded as a monolithic unit.

30. The method according to claim 28 wherein the first and second tethers each comprises a flexible strap.

31. The method according to claim 28 wherein the base comprises a base ring; and wherein the first and second tethers extend outwardly from opposite sides of the base ring.

32. The method according to claim 28 wherein each plug tether assembly further comprises at least one first snap-fitting feature carried by the base.

33. The method according to claim 28 wherein the cable inlet plug comprises a hollow closure cap and a gripping member extending outwardly therefrom; and wherein the fastener inlet plug comprises at least one hollow closure cap and a gripping member extending outwardly therefrom.

* * * * *